US008240880B2

(12) United States Patent
Chen et al.

(10) Patent No.: US 8,240,880 B2
(45) Date of Patent: Aug. 14, 2012

(54) LED ILLUMINATION MODULE WITH LARGE LIGHT EMITTING ANGLE

(75) Inventors: Chin-Chung Chen, Taipei Hsien (TW); Hai-Wei Zhang, Shenzhen (CN); Ci-Jin Mo, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 431 days.

(21) Appl. No.: 12/549,394

(22) Filed: Aug. 28, 2009

(65) Prior Publication Data

US 2010/0328939 A1 Dec. 30, 2010

(30) Foreign Application Priority Data

Jun. 30, 2009 (CN) ..... 2009 1 0303868

(51) Int. Cl.
*F21V 1/00* (2006.01)

(52) U.S. Cl. ..... 362/247; 362/243; 362/235

(58) Field of Classification Search ..... 362/240, 362/241, 243, 245, 247, 249.02, 296.01, 362/296.05–296.08, 341, 347, 350, 235, 362/230, 231, 800

See application file for complete search history.

(56) References Cited

U.S. PATENT DOCUMENTS

| | | | | |
|---|---|---|---|---|
| 6,183,100 | B1 * | 2/2001 | Suckow et al. | 362/35 |
| 6,364,506 | B1 * | 4/2002 | Gallo | 362/245 |
| 6,464,373 | B1 * | 10/2002 | Petrick | 362/235 |
| 7,160,004 | B2 * | 1/2007 | Peck | 362/341 |
| 7,758,210 | B2 * | 7/2010 | Peck | 362/247 |
| 8,033,638 | B2 * | 10/2011 | Umeda | 347/33 |
| 8,033,683 | B2 * | 10/2011 | Fields | 362/231 |
| 2006/0209541 | A1 * | 9/2006 | Peck | 362/247 |
| 2006/0274526 | A1 * | 12/2006 | Weston et al. | 362/252 |
| 2007/0002572 | A1 * | 1/2007 | Ewig et al. | 362/470 |

* cited by examiner

*Primary Examiner* — Bao Q Truong
(74) *Attorney, Agent, or Firm* — Altis Law Group, Inc.

(57) ABSTRACT

An LED illumination module includes a base, a plurality of first LEDs disposed on a top side of the base and a reflecting barrel disposed on the top side of the base. The first LEDs are disposed outside of the reflecting barrel, whereby light generated by the first LEDs is reflected by the reflecting barrel to illuminate a space below a bottom side of the base.

17 Claims, 7 Drawing Sheets

LED ILLUMINATION MODULE WITH LARGE LIGHT EMITTING ANGLE

BACKGROUND

1. Technical Field

The disclosure relates to illumination devices and, particularly, to an LED (light emitting diode) illumination module with a large light emitting angle.

2. Description of Related Art

LED illumination devices have been quickly developed in recent years. Compared with traditional illumination devices, the advantages of the LED illumination devices are small volume, short response time, long life, low driving voltage and better anti-shock capability. Traditionally, the LED illumination device is manufactured through two general optical design processes to form primary and secondary optical systems. The primary optical system generally refers to a transparent resin package covering an LED chip. The primary optical system functions to efficiently extract light out of the LED chip by controlling a distribution of luminous intensity of the emitted light. The secondary optical system is generally constructed by lenses, reflectors, or other optical structures, to optimize the distribution of luminous intensity of the light emitted from the primary optical system.

A light emitting angle of a traditional LED illumination device is less than 120°. When the traditional LED illumination device is applied in carbarn, mine or the like sites which need a three-dimensional illumination effect. Therefore, the traditional LED illumination device having small light emitting angle can not meet this big scale illumination demand.

What is needed, therefore, is an LED illumination module with a large light emitting angle which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
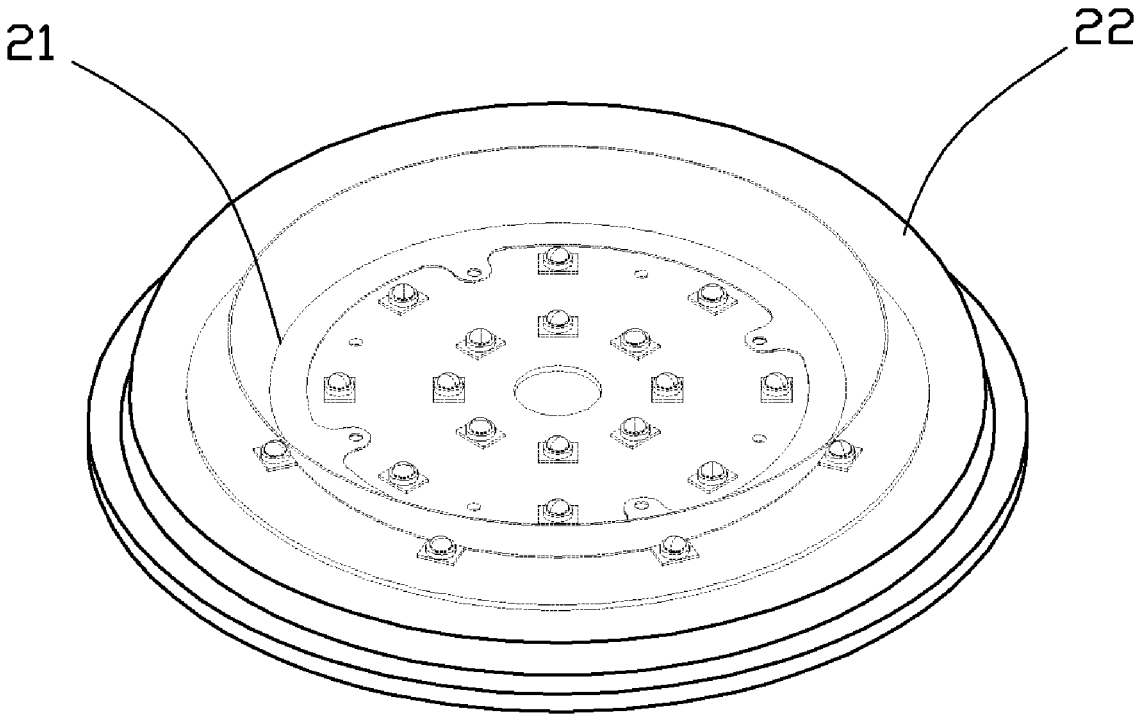
FIG. 1 is an assembled view of an LED illumination module in accordance with an embodiment of the disclosure.
Figure 2:
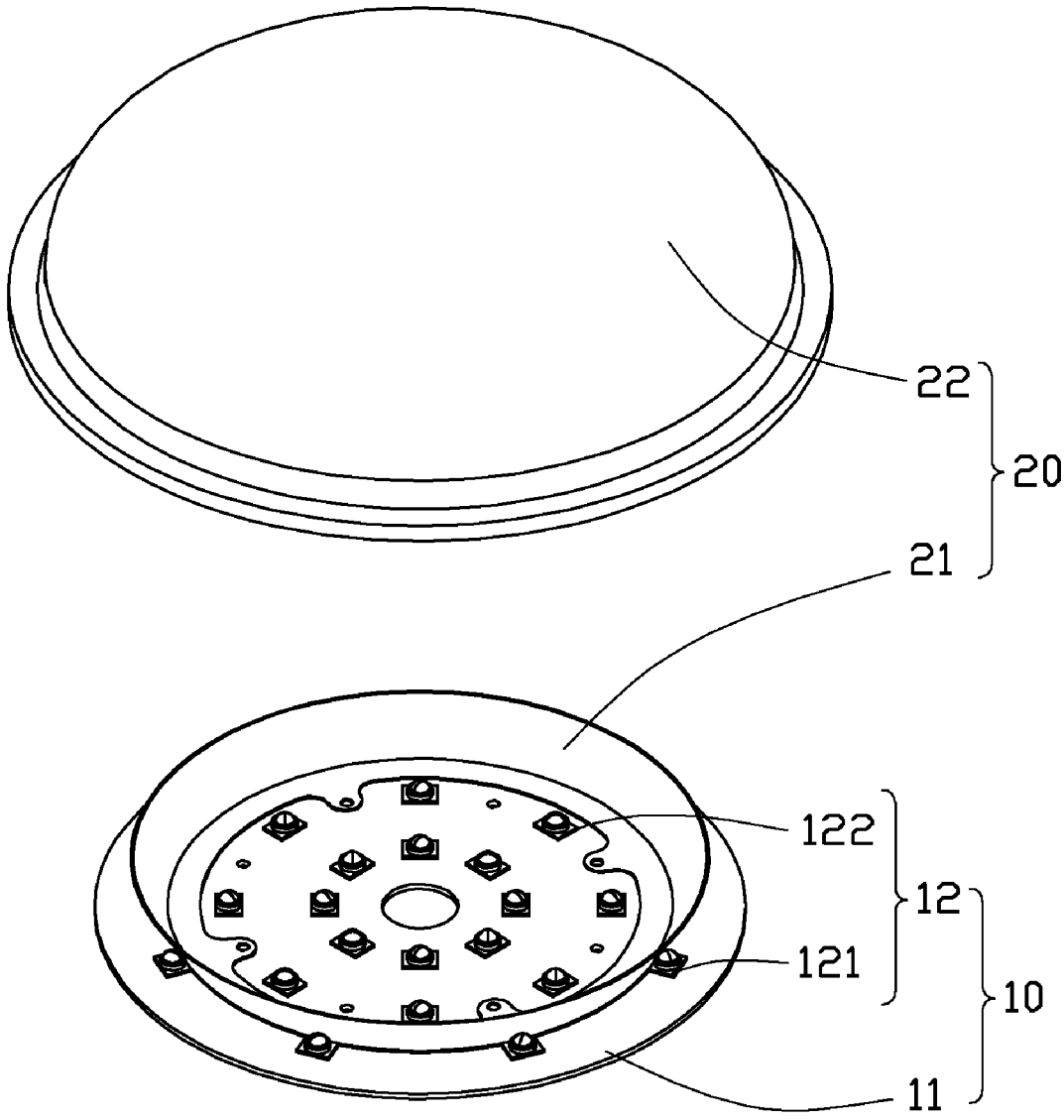
FIG. 2 is a view similar to FIG. 1, with an envelope of the LED illumination module being separated therefrom.
Figure 3:
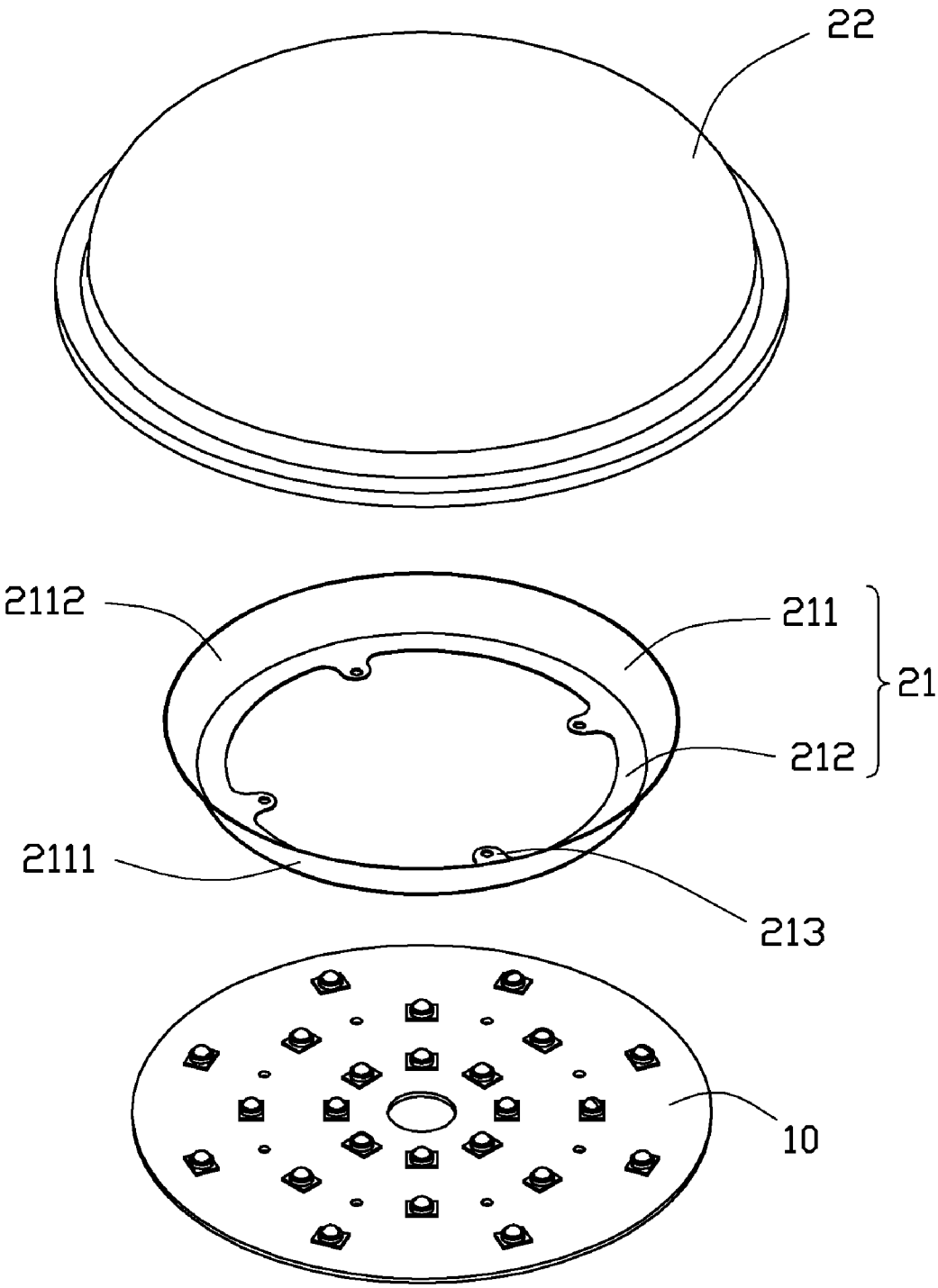
FIG. 3 is an isometric, exploded view of FIG. 1.

Referring to FIGS. 1-3, an LED illumination module includes a light source module 10 and an optical system 20 cooperating with the light source module 10. The light source module 10 includes a printed circuit board 11 and a plurality of LEDs 12 mounted on a top side of the printed circuit board 11. The LEDs 12 each include an LED chip packaged by a transparent resin. That is, the transparent resin is a primary optical system; the optical system 20 is a secondary optical system. The optical system 20 functions to guide and adjust light emitting angles of the LEDs 12 to achieve a desired distribution of luminous intensity.

The LEDs 12 includes a first group of LEDs 121 located near an edge region of the top side of the printed circuit board 11, and a second group of LEDs 122 located in a main region of the top side of the printed circuit board 11. That is, the first and second groups of LEDs 121, 122 are in the same top side of the printed circuit board 11, and the first group of LEDs 121 surrounds the second group of LEDs 122. It is understood that the printed circuit board 11 can be replaced by a base which can support the LEDs 12 thereon and electrically connect the LEDs 12 to a power supply. The second group of LEDs 122 is used to illuminate a main working space faced by the top side of the printed circuit board 11, and the first group of LEDs 121 is used to illuminate a periphery working space around the main working space. In the illuminated embodiment, the LEDs of the first group of LEDs 121 are arranged on an imaginary concentric circle, and the LEDs of the second group of LEDs 122 are arranged on a number of imaginary circle inside of the imaginary concentric circle of the first group of LEDs 121.

The optical system 20 includes a reflecting barrel 21 and a light transmission envelope 22. The reflecting barrel 21 is secured to the edge region of the top side of the printed circuit board 11. The envelope 22 covers the LEDs 12 and the reflecting barrel 21 therein. The reflecting barrel 21 includes a small opening end mounted to the top side of the printed circuit board 11, a free large opening end and a reflecting part 211 between the small and large opening ends. A flange 212 extends inwardly from a circumferential edge of the small opening end of the reflecting barrel 21. A plurality of ears 213 extends inwardly from the flange 212 of the reflecting barrel 21; the ears 213 each define a through hole (not labeled) therein. The printed circuit board 11 defines a plurality of screw holes corresponding to the through holes of the ears 213, a plurality of screws (not shown) extends through the through holes of the ears 213 of the reflecting barrel 21 and screws in the screw holes of the printed circuit board 11 to thereby fasten the reflecting barrel 21 to the top side of the printed circuit board 11. The reflecting barrel 21 is arranged between the imaginary circle of the first group of LEDs 121 and the outermost one of the imaginary concentric circles of the second group of LEDs 122. That is, the first group of LEDs 121 is located outside of the reflecting barrel 21, and the second group of LEDs 122 is located inside of the reflecting barrel 21.

A diameter of the reflecting barrel 21 increases gradually from the small opening end to the large opening end of the reflecting barrel 21, i.e., along a direction upwardly away from the printed circuit board 11. The reflecting part 211 of the reflecting barrel 21 includes an outer reflecting surface 2111 and an inner reflecting surface 2112. The outer reflecting surface 2111 is configured to guide the light generated by the first group of LEDs 121 to the periphery working area, e.g., the space below a bottom side of the printed circuit board 11. Thus, the outer reflecting surface 2111 is inclined to the printed circuit board 11 and can be a flat or curved surface. The inner reflecting surface 2112 can also be a flat or curved surface to reflect and guide the light generated by the second group of LEDs 122 out from the reflecting barrel 21 and to illuminate the main working area, e.g., the space over printed circuit board 11. The outer reflecting surface 2111 and the inner reflecting surface 2112 each can be a paraboloid surface, a spherical surface, aspheric surface or an ellipsoid surface.

The combination of the first and second groups of LEDs 121, 122 can illuminate both of the periphery working area and the main working area, thereby ensuring the light emitting angle of the LED illumination module being larger than 180° (and less than 360°). In detail, the light generated by the second group of LEDs 122 mostly distribute to the main working area where the light emitting angle of the LED illumination module ranges from 0° to about 120°, and partially distribute to the glare area where the light emitting angle of the LED illumination module ranges from about 120° to about 180° where the glare easily occurs. In the main working area, the light has a high luminous intensity to thereby meet a practical illumination requirement. In the glare area, the light has a low luminous intensity to thereby weaken the glare intensity of the whole LED illumination module. The light generated by the first group of LEDs 121 distributes to the periphery working area where the light emitting angle of the LED illumination module ranges larger than 180° (i.e., the space below the bottom side of printed circuit board 11), even reach 210°. Therefore, LED illumination module acquires a large light emitting angle.

The reflecting barrel 21 can be made of plastic or metallic material. According to practical requirement, the outer and inner reflecting surfaces 2111, 2112 can be surface treated to optimize the light reflection. For example, the outer and inner reflecting surfaces 2111, 2112 are treated to be diffusively reflective surfaces by forming, spraying or coating white reflecting material thereon; or the reflecting surfaces 2111, 2112 are treated to be highly reflective surfaces by polishing the reflecting surfaces 2111, 2112 when the reflecting barrel 21 is made of metallic material or plating a metallic coating thereon when the reflecting barrel 21 is made of plastic material.

The envelope 22 includes a main part 221 corresponding to the second group of LEDs 122 and a periphery part 222 corresponding to the first group of LEDs 121. The main part 221 is a circular flat sheet, and the periphery part 222 bends downwardly from a circumferential edge of the main part 221 to form a circular configuration. The main part 221 and the periphery part 222 each are used to optimally guide the light out of the envelope 22 and protect the LEDs 12.

The envelope 22 can be made of glass, polycarbonate, polymethyl methacrylate or other suitable material. The envelope 22 can be treated to be frosted structure or transparent structure to achieve various light guide effect. The envelope 22 can be frosted by sandblasting, doping diffuse particles or pasting diffuse film. Preferably, an inner surface of the envelope 22 is processed by the sandblasting process or is pasted a diffuse filmed. The diffuse particles are doped in a raw material such as the polycarbonate, and the raw material containing the diffuse particles undergoes an injection molding process to get the envelope 22 having the diffuse particles doped therein.

Figure 4:
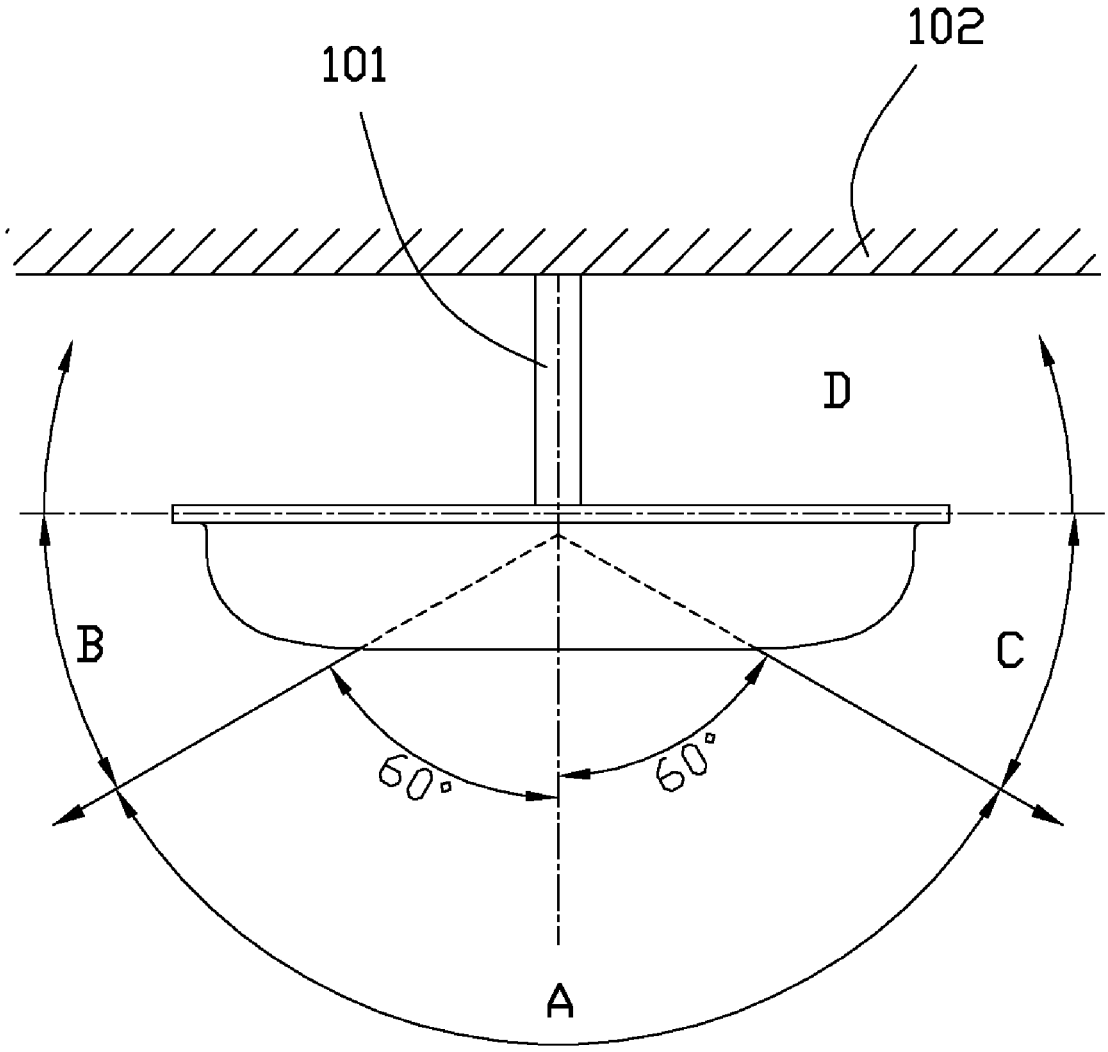
FIG. 4 is an illustrative view showing an angular distribution of the light generated by the LED lighting module of FIG. 1.

The above-described LED illumination module can be cooperated with other structures to form various illumination devices. For example, the LED illumination module shown in FIG. 1 is inverted and secured to a ceiling 102 by a suspension rod 101, as shown in FIG. 4. Referring to FIG. 4, the LED illumination module has three illumination regions, that is, the main working area (i.e., the light emitting angle of the LED illumination module ranges from 0° to about 60°, denoted by A), the glare area (i.e., the light emitting angle of the LED illumination module ranges from above 60° to about 90°, denoted by B and C), and the periphery working area (i.e., the light emitting angle of the LED illumination module is larger than 90°, denoted by D). In operation, light generated by the second group of LEDs 122 is reflected by the inner reflecting surface 2112 of the reflecting barrel 21 to illuminate the main working area and the glare area; the light in the main working region has a high luminous intensity which can meet a practical illumination requirement, and the light in the glare area has a low luminous intensity to thereby weaken the glare effect. The light generated by the first group of LEDs 121 is reflected by the outer reflecting surface 2111 of the reflecting barrel 21 to illuminate the periphery working area.

Various configurations of the envelope 22 and the outer reflecting surface 2111 of the reflecting barrel 21 can construct various LED illumination modules. There are three examples given below.

Example 1

Figure 5:
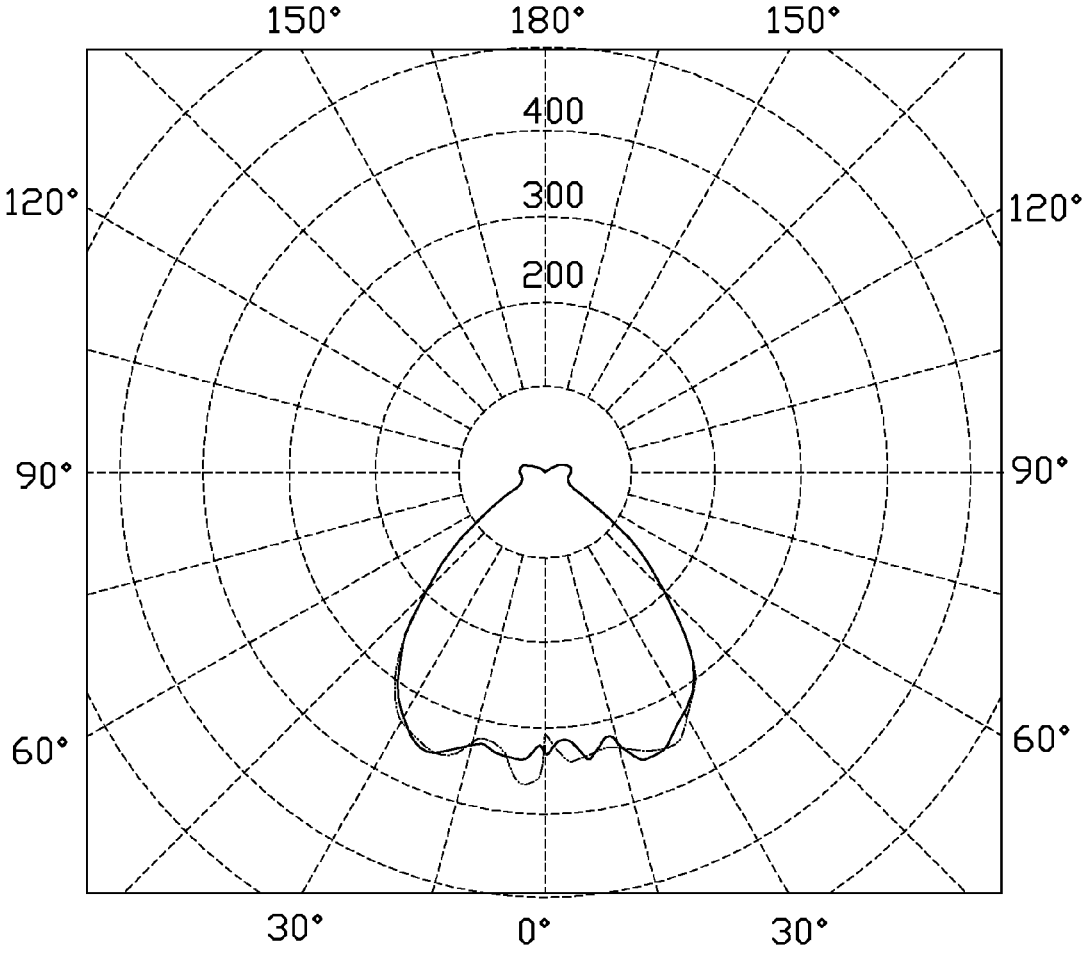
FIG. 5 is a distribution curve of luminous intensity of the LED illumination module of example 1 of the embodiment.

The envelope 22 is a transparent structure, the outer reflecting surface 2111 of the reflecting barrel 21 is a white diffusely reflective surface, and a distribution curve of luminous intensity of the LED illumination module of this example is shown in FIG. 5. Referring to FIGS. 4-5, when the light emitting angle of the LED illumination module is less than 60° which is the main working area, the luminous intensity is relatively high; when the light emitting angle ranges from 60° to 90° which is the glare area, the luminous intensity is relatively low; and when the light emitting angle is larger 90° (even is equal to 120°) which is the periphery working area, the LED illumination module also has a certain luminous intensity. Particularly, in the periphery working area, although the luminous intensity of the LED illumination module is relatively low, this low luminous intensity can meet practical requirement due to the LED illumination module and the ceiling 102 therebetween has a relatively short distance.

Example 2

Figure 6:
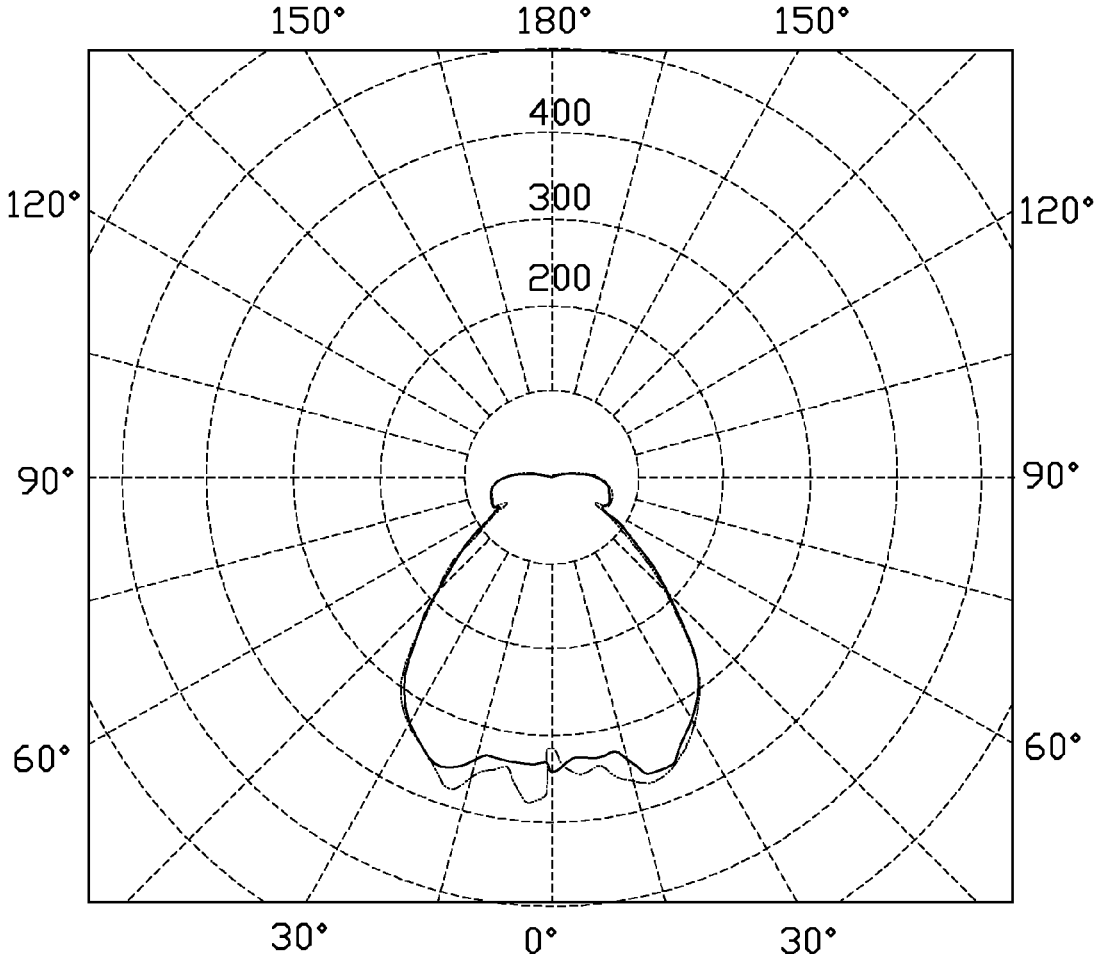
FIG. 6 is a distribution curve of luminous intensity of the LED illumination module of example 2 of the embodiment.

The envelope 22 is a transparent structure, the outer reflecting surface 2111 of the reflecting barrel 21 is a highly reflective surface by plating aluminum thereon, and a distribution curve of luminous intensity of the LED illumination module of this example is shown in FIG. 6. The illumination performance of the LED illumination module of example 2 is similar to that of example 1.

Example 3

Figure 7:
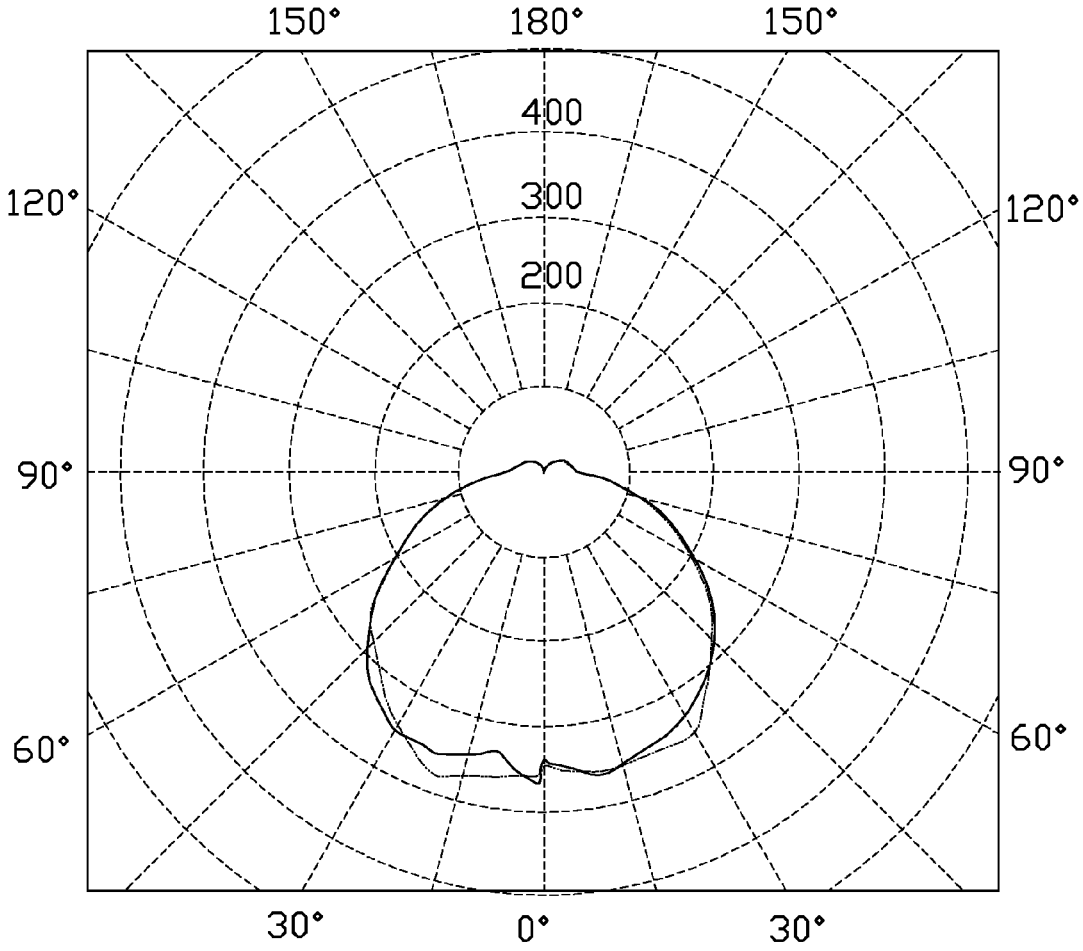
FIG. 7 is a distribution curve of luminous intensity of the LED illumination module of example 3 of the embodiment.

The envelope 22 is a frosted structure, the outer reflecting surface 2111 of the reflecting barrel 21 can be a diffusively or a highly reflective surface, and a distribution curve of luminous intensity of the LED illumination module of this example is shown in FIG. 7. The distribution curve of luminous intensity of the LED illumination module of example 3 is similar to a circle. That is, the luminous intensities of the LED illumination module are evenly distributed at various light emitting angles. Therefore, the LED illumination module of example 3 glows softly, and can not discomfort human eyes.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED illumination module comprising:

a base;

a plurality of first LEDs disposed on a top side of the base;

a reflecting barrel disposed on the top side of the base; and a plurality of second LEDs disposed on the top side of the base and located inside of the reflecting barrel;

wherein the plurality of first LEDs is disposed outside of the reflecting barrel, whereby light generated by the first LEDs is reflected by the reflecting barrel to illuminate a space below a bottom side of the base.

2. The LED illumination module of claim 1, wherein the first LEDs are arranged on a first imaginary circle, the second LEDs are arranged on a plurality of second imaginary concentric circles inside of the first imaginary circle.

3. The LED illumination module of claim 2, wherein the reflecting barrel is located between the first imaginary circle of the first LEDs and the outermost one of the second concentric imaginary circles of the second LEDs.

4. The LED illumination module of claim 1, wherein the reflecting barrel comprises a small opening end secured to the top side of the base, a free large opening end away from the top side of the base and a reflecting part between the small and large opening ends.

5. The LED illumination module of claim 4, wherein a diameter of the reflecting part of the reflecting barrel increases gradually from the small opening end to the large opening end of the reflecting barrel.

6. The LED illumination module of claim 5, wherein the reflecting part of the reflecting barrel has an outer reflecting surface facing the first LEDs and an inner reflecting surface facing the second LEDs.

7. The LED illumination module of claim 6, wherein the outer and inner reflecting surfaces each are one of a paraboloid surface, a spherical surface, an aspheric surface and an ellipsoid surface.

8. The LED illumination module of claim 7, wherein the outer and inner reflecting surfaces each are one of a diffusively reflective surface and a highly reflective surface.

9. The LED illumination module of claim 1, further comprising an envelope having a main part corresponding to the second LEDs and a periphery part corresponding to the first LEDs.

10. The LED illumination module of claim 9, wherein the envelope is one of a frosted structure and a transparent structure.

11. The LED illumination module of claim 10, wherein the frosted structure is formed by one of sandblasting, doping diffuse particles and pasting diffuse film.

12. An LED illumination module comprising:

a base;

a first group of LEDs disposed on edge region of a top side of the base;

a second group of LEDs disposed on a main region of the top side of the base and being surrounded by the first group of LEDs; and a reflecting barrel disposed on the top side of the base;

wherein the first group of LEDs is located outside of the reflecting barrel, whereby light generated by the first group of LEDs is reflected by the reflecting barrel to illuminate a space below a bottom side of the base.

13. The LED illumination module of claim 12, wherein the reflecting barrel comprises a small opening end secured to the top side of the base, a free large opening end away from the top side of the base and a reflecting part between the small and large opening ends.

14. The LED illumination module of claim 13, wherein a diameter of the reflecting part of the reflecting barrel increases gradually from the small opening end to the large opening end of the reflecting barrel.

15. The LED illumination module of claim 14, wherein the reflecting part of the reflecting barrel has an outer reflecting surface facing the first LEDs and an inner reflecting surface facing the second LEDs.

16. The LED illumination module of claim 15, wherein the outer and inner reflecting surfaces each are one of a paraboloid surface, a spherical surface, an aspheric surface and an ellipsoid surface.

17. The LED illumination module of claim 15, wherein the outer and inner reflecting surfaces each are one of a diffusively reflective surface and a highly reflective surface.

* * * * *